United States Patent [19]

Kolator

[11] 4,052,685

[45] Oct. 4, 1977

[54] CURRENT TRANSFORMER

[75] Inventor: Tadeusz W. Kolator, Lucan, Canada

[73] Assignee: Westinghouse Canada Limited, Hamilton, Canada

[21] Appl. No.: 738,810

[22] Filed: Nov. 4, 1976

[30] Foreign Application Priority Data

May 31, 1976 Canada ..... 253775

[51] Int. Cl.[2] ..... H01F 27/10

[52] U.S. Cl. ..... 336/60; 336/62

[58] Field of Search ..... 336/62, 60, 55, 57, 336/173, 174; 219/10.51

[56] References Cited

U.S. PATENT DOCUMENTS

| | | | |
|---|---|---|---|
| 1,882,075 | 10/1932 | Gebhard | 336/62 |
| 1,938,607 | 12/1933 | Noyes | 336/62 |
| 1,939,689 | 12/1933 | Gebhard | 336/62 X |
| 3,299,383 | 1/1967 | Conner et al. | 336/62 X |
| 3,686,598 | 8/1972 | Ozawa | 336/62 |

FOREIGN PATENT DOCUMENTS

| | | | |
|---|---|---|---|
| 64,337 | 11/1955 | France | 336/62 |
| 630,353 | 10/1949 | United Kingdom | 336/62 |

*Primary Examiner*—Thomas J. Kozma
*Attorney, Agent, or Firm*—D. R. Lackey

[57] ABSTRACT

A post type oil filled current transformer having a U-shaped primary winding formed of a tubular conductor. An oil flow controlling hollow tubular member is disposed within the primary conductor. The tubular oil flow controlling member is vertically oriented and spaced from the internal wall of the tubular primary winding to define inner and outer coaxial paths permitting a downward flow of cool oil in the inner path within the tubular member and an upward flow of heated oil in the outer path between the tubular member and the inner wall of the primary winding.

4 Claims, 3 Drawing Figures

CURRENT TRANSFORMER

BACKGROUND OF THE INVENTION

1. Field of the Invention

The invention relates in general to electrical inductive apparatus, such as instrument transformers, and more specifically to new and improved high voltage current transformers.

2. Description of the Prior Art

Current transformers for high voltage application are frequently arranged in what are referred to as post-type enclosures. The enclosure includes a grounded tank portion and an insulating portion, for example, porcelain, which is quite tall and narrow to provide the necessary isolation from ground. Within this post-type enclosure is arranged a U-shaped or hair-pin primary winding or conductor for carrying current between terminals provided at the top of the enclosure which connect the hair-pin primary winding in the high voltage line. A secondary winding is provided around a length of the hair-pin primary winding at the lower end of the enclosure at low tension which may be used for measurement purposes. Substantial insulation is provided between the hair-pin primary winding and the secondary winding and between the hair-pin primary winding and the grounded portion of the enclosure. The enclosure is filled with oil which serves to improve the insulation and also provides for dissipation of heat generated in the conductors due both to $r^2r$ loss and circulating currents. The only exit for the heat generated in the windings is through the oil and to the enclosure and from the enclosure to the surrounding air. Because of the shape of the current transformer structure, the heavy insulation and the shape of the primary winding, the circulation of the oil or other filling fluid is considerably hampered. As a result, it is difficult to properly cool the windings, in particular, the primary winding.

SUMMARY OF THE INVENTION

Briefly, the present invention is a new and improved current transformer in which the primary winding of the transformer is in the form of a hair-pin or U-shape, and is formed from a tubular conductor which is filled with cooling oil or fluid. A fluid conducting tube is introduced into the primary winding substantially coaxial within it and terminating at a low point in the primary winding. The other end of the tube is located at a cool point in the fluid which will usually be a low point in the container.

In operation, the fluid is heated by the losses in the primary winding causing the fluid to rise from the low point of the primary winding to the high point where it can flow out into the enclosure. In order to permit this fluid to flow out of the primary winding into the enclosure, more fluid must be introduced and this fluid flows in from the termination of the coaxial tube and, since the other end of the tube is located at a cool point in the fluid, the fluid introduced into the primary is the cooler fluid in the system. Thus, the tube provides a fluid coupling between a low temperture and high temperature location in the system and promotes circulation of the fluid within the enclosure, thus increasing heat dissipation.

BRIEF DESCRIPTION OF THE DRAWINGS

A clearer understanding of the my invention may be had from a consideration of the following drawings in which.

DESCRIPTION OF PREFERRED EMBODIMENTS

Figure 1:
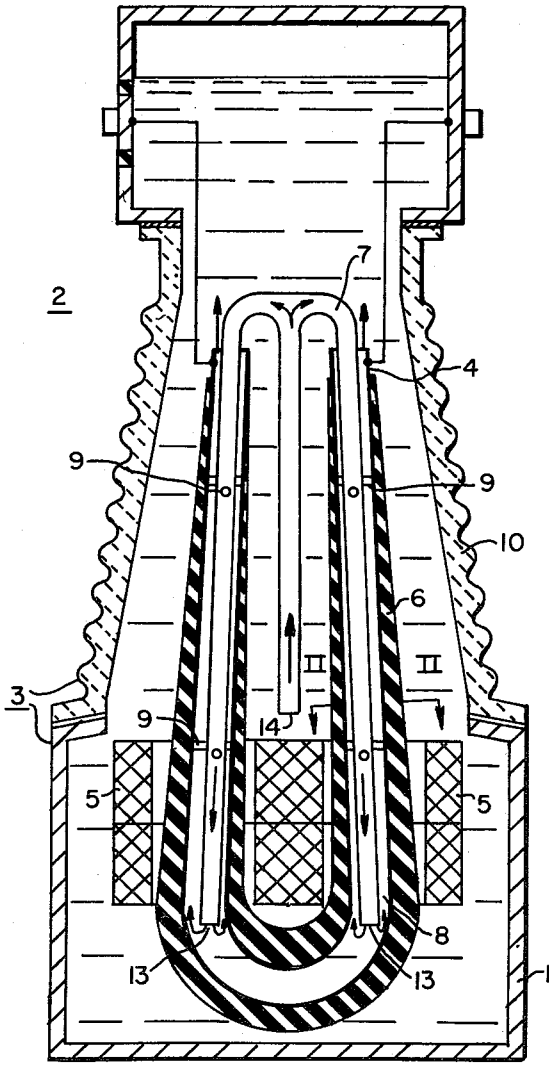
FIG. 1 is an elevational sectional view of the windings of a current transformer embodying the invention.

Considering first FIG. 1, there is shown the windings of a current transformer 2 which includes a primary winding 4 of a vertically oriented, hollow copper conductor in the form of a hair-pin or U-shape, and a secondary winding 5 which consists of a number of turns in coils surrounding the legs of the hair-pin. The hair-pin primary winding 4 is insulated from ground and from the secondary winding 5 by means of an insulation layer 6, which increases in thickness from the top end of the hair-pin to the bottom end in accordance with the potential gradient to which the winding is exposed due to the structure of the transformer. As will be understood by one skilled in the art, the upper end of the transformer 2 will be attached to a high voltage line and therefore must be substantially insulated from the lower end of the transformer which normally would be mounted at ground potential. The whole of the windings are normally encased in an enclosure 3, which includes, for example, a truncated, conical, porcelain insulator 10 sealably mounted to a metallic tank 11 which encloses the lower end of the transformer including the secondary winding. The enclosure 3 is filled with a suitable non-conductive fluid 8, for example, oil, which bathes the insulation and impregnates the insulation of both winding 4 and 5 and also serves to conduct heat from the windings to the surface of the enclosure 3 where it may be dissipated into the air.

To increase this dissipation of heat, a coaxial tube 7 is passed down through the open end of conductor which forms the primary winding 4 so that the lower open end 13 of tube 7 is near the bottom of the hair-pin configuration. This arrangement creates first and second substantially coaxial flow paths for the oil 8, with the first flow path being within the tube 7, and with the second flow path being between the tube 7 and the inner wall of the conductor which forms the primary winding 4. The first and second flow paths are interconnected at the open end of tube 7 within the winding 4. The other end 14 of tube 7 is located in the open space between the two legs of the primary winding 4 at a cool location near the bottom of the enclosure 3.

In operation, losses in the conductor of the primary winding 4 cause this conductor to increase in temperature which heats the insulating fluid 8. If the temperature of the fluid in the annular path between the conductor of the primary winding 4 and the tube 7 is hotter than the fluid within tube 7, then the hotter fluid will rise and flow out of the upper ends of the conductor of the primary winding 4 and this fluid will be replaced with fluid from within the tube 7, flowing from its open lower end 13, which fluid is drawn from the low temperature location of the other end 14 or the tube 7.

While the foregoing description has been associated with the right-hand portion of the drawing, it will be evident the corresponding events are occurring on the left-hand portion of the drawing and the single central stem of tube 7 supplies cool fluid to both ends 13 of the tube 7 within the conductor of the primary windings 4. The fluid flow induced by the separation of the paths of the hot and the cool fluid increases the circulation of fluid and thereby facilitates the transfer of heat from the conductor 4 to the outer wall of the enclosure 3.

Figure 2:
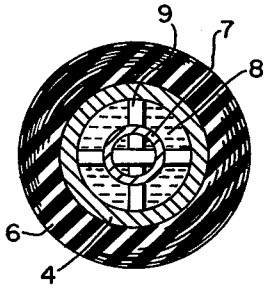
FIG. 2 is a section of a portion of the primary winding shown in FIG. 1 at section lines 2—2.

The two parallel paths can be clearly seen in FIG. 2 which is a section of the conductor 4 showing the insulation 6, the tube 7 and the fluid 8.

Figure 3:
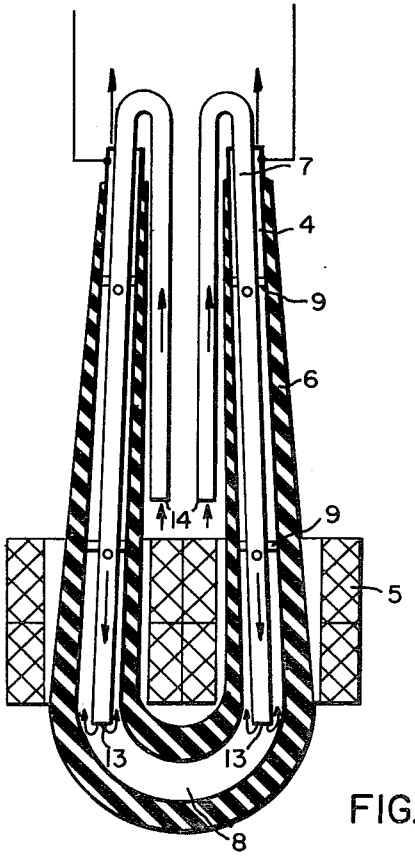
FIG. 3 is an elevational sectional view of a portion of a transformer including an alternate embodiment.

Another embodiment of the invention, shown in FIG. 3, substitutes two separate tubular members 7' and 7'' for the bifurcated tube 7 shown in FIG. 1. The corresponding parts bear corresponding designations and the mode of operation is substantially the same as described in relation to FIG. 1.

A still greater coolant flow may be promoted by the addition of an impeller (not shown) which may, for example, be operated by an immersed motor to propel the cool oil upwards through the end 14 of the tube 7.

The conductor of the primary winding 4 and its insulation, and the associated secondary coil 5 is manufactured in the usual manner utilizing materials well known in the art. The fluid conducting tube 7 may be made of paper, plastic, rubber, glass, metal or any other suitable material. If made of metal, it is essential that it be spaced from the conductor of the primary winding 4 and in any event, spacers 9 are advantageous to ensure that the tube 7 is held essentially in the center of the conductor of the primary winding 4. The spacers 9 are constructed to create as little interference with the flow of oil 8 as is practical and may take the form, as shown in FIG. 2, of a number of insulating pins which project through the tube 7 and engage the inner wall of conductor of the primary winding 4.

What is claimed is:

1. A current transformer, comprising:

an enclosure;

an insulating fluid disposed in said enclosure;

a winding disposed in said enclosure, said winding including a substantially vertical oriented U-shaped tubular conductor having upwardly extending legs with open ends;

means for increasing the circulation of said insulating fluid, including a fluid conductor disposed within said U-shaped tubular conductor to define first and second substantially coaxial flow paths for said insulating fluid, with the first path being within said fluid conductor, and the second path being between said fluid conductor and said tubular conductor;

said first and second flow paths being interconnected at a point within said winding;

said fluid conductor including first and second downwardly extending legs joined in common adjacent one of said open ends of said U-shaped conductor, said first leg disposed within one of said upwardly extending legs of said U-shaped conductor, said second leg extending downwardly into the cooler insulating fluid removed from said open end of said U-shaped conductor.

2. The current transformer of claim 1 wherein the fluid conductor is an insulating tube concentrically supported in the tubular conductor, and extending substantially to the bottom of the U-shaped conductor.

3. The current transformer of claim 1 wherein the fluid conductor includes a third downwardly extending leg joined in common with the first and second legs of said fluid conductor adjacent one of the legs of the U-shaped conductor, said third leg being disposed within the other leg of said U-shaped conductor.

4. The current transformer of claim 1 wherein the fluid conductor includes third and fourth downwardly extending legs joined in common adjacent the other open end of the U-shaped conductor, said third leg disposed within the other upwardly extending leg of said U-shaped conductor, said fourth leg extending downwardly into the cooler insulating fluid removed from said other open end of said U-shaped conductor.

* * * * *